United States Patent [19]

Ohshima

[11] 4,274,217

[45] Jun. 23, 1981

[54] DISPLAY DEVICE

[75] Inventor: Masauki Ohshima, Tottori, Japan

[73] Assignees: Sanyo Electric Co., Ltd., Moriguchi; Tottori Sanyo Electric Co., Ltd., Tottori, both of Japan

[21] Appl. No.: 60,627

[22] Filed: Jul. 25, 1979

[30] Foreign Application Priority Data

Jul. 25, 1978 [JP] Japan ..... 53-102858[U]
Oct. 30, 1978 [JP] Japan ..... 53-134888

[51] Int. Cl.[3] ..... G09F 3/04
[52] U.S. Cl. ..... 40/451
[58] Field of Search ..... 40/451, 450; 340/383

[56] References Cited

U.S. PATENT DOCUMENTS 3,226,864 1/1966 Rehier ..... 40/451
3,481,062 12/1969 Du Bois et al. ..... 40/451
3,798,445 3/1974 Miles ..... 340/383
3,895,380 7/1975 Nishima et al. ..... 340/383

*Primary Examiner*—Gene Mancene
*Assistant Examiner*—Wenceslao J. Contreras
*Attorney, Agent, or Firm*—Armstrong, Nikaido, Marmelstein & Kubovcik

[57] ABSTRACT

This invention is directed to a display device comprising light reflecting block means having at least one light path defined by wall members for reflecting the light emitted from a light emitting diode placed within said light path which is provided with an elongated opening for constituting a display segment and composite lens means having a plurality of juxtaposed lens columns and Fresnel part, said composite lens means are located on the light reflecting block means so that the display segment can be illuminated with uniform and intensive brightness upon electrically activation of the light emitting diode.

15 Claims, 17 Drawing Figures

Fig. 13

| semi cylindlical lens portion | | concave cylindlical lens portion | | modified lenticular lens | | |
|---|---|---|---|---|---|---|
| radius of curvature $r_1$ | width $P_1$ | radius of curvature $r_2$ | width $P_2$ | cross sectional configuration | | |
| | | | | $P_1 > P_2$ | $P_1 = P_2$ | $P_1 < P_2$ |
| $2r_1 = P_1$ | | $2r_2 = P_2$ | | $\ell 11$ | $\ell 21$ | $\ell 31$ |
| | | $2r_2 > P_2$ | | $\ell 12$ | $\ell 22$ | $\ell 32$ |
| $2r_1 > P_1$ | | $2r_2 = P_2$ | | $\ell 13$ | $\ell 23$ | $\ell 33$ |
| | | $2r_2 > P_2$ | | $\ell 14$ | $\ell 24$ | $\ell 34$ |

DISPLAY DEVICE

FIELD OF THE INVENTION

The present invention relates to a display device comprising one or more light paths having openings at their top ends for displaying a predetermined pattern such as alpha numeric character upon illumination of corresponding point sources of light disposed in the respective light paths.

BACKGROUND OF THE INVENTION

A conventional display device of the type for displaying alpha numeric characters is composed of as shown in FIG. 1, a light reflecting block 1 having a plurality of light paths 2 for making up respective segments of the alpha numeric character with their uppermost openings 3, light emitting diodes 4 each of which is disposed on a substrate 5 within each of the light paths 2 for illuminating corresponding uppermost openings 3 upon activation of the light emitting diode 4 and a light diffusion sheet 6 laid on the light reflecting block 1. However, the light absorvability of the light diffusion sheet 6 laid on the light reflecting block 1 is so high that, when a light emitting diode is electrically activated, the corresponding segment is illuminated dark as compared to the intensity of light emitted by the light emitting diode. In order to increase the intensity of the light illuminated by the segment, a lens sheet 7 is employed in place of the light diffusion sheet 6. Said lens 7 sheet is formed with lenticular lens parts in respective positions opposed to the uppermost openings 3 for making the display of the segments uniform.

A display device of the type is disclosed in U.S. Pat. No. 3,786,499.

In the conventional display device as mentioned above, there is a disadvantage that both end portions of the lengthwise direction of a segment tend to become dark relative to the intermediate part of the segment when the segment is illuminated upon activation of the corresponding light emitting diode.

According to the conventional display device of the type mentioned above, the image of the light made up on one segment tends to include a series of lighting spots lined up in the lengthwise direction thereof due to the lens effect of every lens columns of the lenticular lens. Under such condition, since the light emitting area of the light emitting diode is so tiny that respective sizes of the light emitting spots 8 appearing on both end portions of one segment tend to become smaller as shown in FIG. 2 compared to those of the lighting spots displayed on the intermediate portion of the segment, thereby resulting in unsightly display of a character.

On the other hand, a Fresnel lens is used in place of the lenticular lens, the shape of image of the segment displayed varies corresponding to the view angle of a viewer relative to the segment. In addition, to make up a desired image of the illuminated segment, it is necessary to adjust the focus of the Fresnel lens relative to the light emitting diode. But the work of adjusting the focus is difficult and time consuming.

SUMMARY OF THE INVENTION

It is therefor an essential object of the present invention to provide a display device in which one or more segments are capable of being illuminated with high intensity of light and uniform brightness upon activation of light emitting means for illuminating said segments.

Another object of the present invention is to provide a display device in which such uniform brightness of the segment or segments can be assured without adjusting the focus of lens means located on the segments relative to the light emitting means.

Still further object of the present invention is to provide a display device in which such uniform brightness of the segment or segments can be assured when viewed in any direction.

These and other objects and features of the present invention will be apparent from the description made hereinafter in conjunction with preferred embodiments of the present invention with reference to the attached drawings.

BRIEF DESCRIPTION OF THE DRAWINGS

FIG. 13 is a schematic diagram showing various features of the modified lenticular lens shown in FIG. 9 classified in accordance with the radius of curvature of the lens column and the radius of curvature of the dale.

DETAILED DESCRIPTION OF THE PREFERRED EMBODIMENTS

Figure 1:
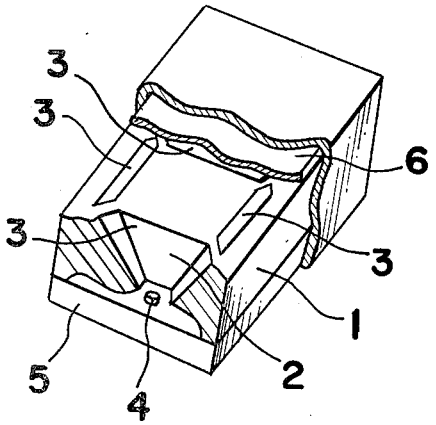
Fig. 1 (PRIOR ART)
FIG. 1 shows a perspective view of a conventional display device.
Figure 2:
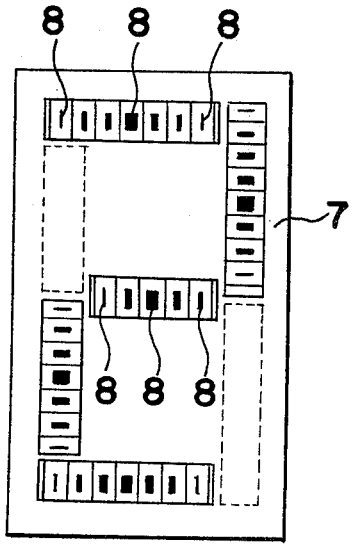
Fig. 2 (PRIOR ART)
FIG. 2 is a plan view showing a defect being inherent in a conventional display device.
Figure 3:
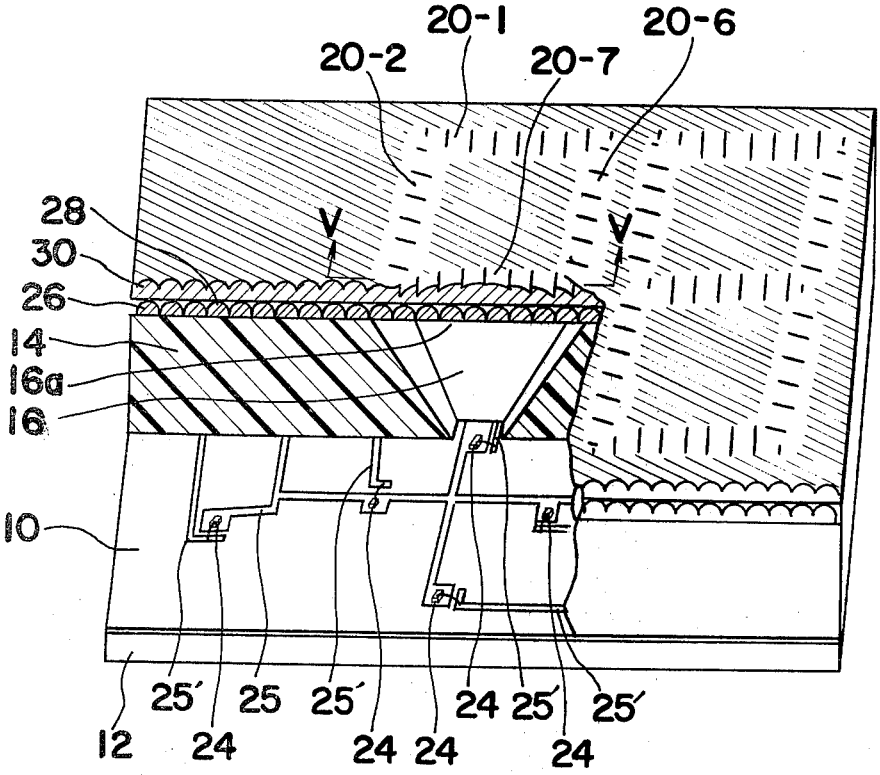
FIG. 3 is a perspective view of an embodiment of a display device according to the present invention.
Figure 4:
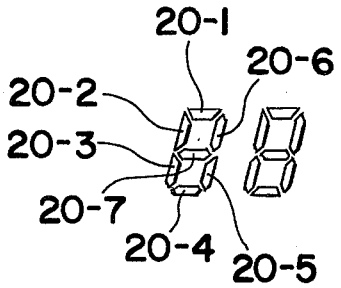
FIG. 4 is a schematic diagram showing an example of an arrangement of segments to define alpha numeric characters, employed in the display device shown in FIG. 3.
Figure 5:
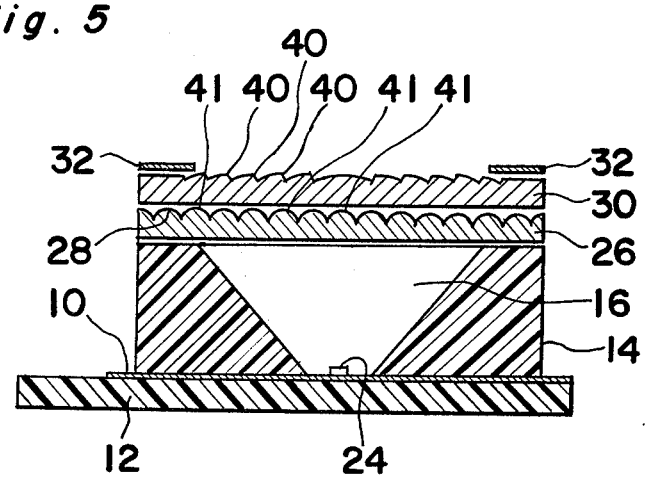
FIG. 5 is a cross sectional view taken along the v—v line in FIG. 3, FIGS. 6 (*a*) and (*b*) show plan views of example of lens means employed in the embodiment shown in FIG. 3, FIGS. 7 (*a*) and (*b*) are plan views showing example of lens means employed in the embodiment shown in FIG. 3.

Referring to FIGS. 3 to 5, a printed circuit board 10 laid on a substrate 12 made of electrically insulating material such as epoxy resin is covered with a light reflecting block 14 made of white opaque resin. The light reflecting block 14 has a plurality of light paths 16 provided in such manner that the uppermost elongated opening of each of the light paths 16 is defined in a position corresponding to and in alignment with one of the segments 20-1 to 20-7 of the figure of a digit "8" for displaying one of alpha numeric characters.

Each of the light paths 16 is formed by a hole of a configuration similar to the shape of a generally inverted, truncated pyramid.

A plurality of light emitting diodes 24 of GaP type, for example, are fixedly arranged on the printed circuit board 10 in alignment with the corresponding light paths 16 in such a manner that a single light emitting diode is accomodated in one light path so that rays of light emitted from the diodes 24 can emerge from the respective uppermost openings of the light paths when the corresponding diodes 24 are energized for displaying one of the alpha numeric characters.

Respective terminals of each light emitting diode 24 are connected to corresponding conductors 25 and 25' so that the light emitting diode 24 can be fed an electric power from the conductors 25 and 25'.

A lenticular lens plate 26 is laid on the upper surface of the light reflecting block 14 in opposite relation to the printed circuit board 10. This lenticular lens plate 26 has a flat surface held in contact with the light reflecting block 14, the opposite surface of which is formed with a plurality of groups of juxtaposed lens columns 28, the number of the groups of said juxtaposed lens columns 28 being equal to the number of the light paths 16 while the groups of the juxtaposed lens columns 28 are arranged in a shape similar to, and in alignment to, the shape of arrangement of the uppermost elongated openings 16*a* of the respective light paths 16. These groups of the juxtaposed lens columns 28 are, when the lenticular lens plate 26 is so mounted on the light reflecting block 14 in the manner described above, aligned respectively with the corresponding uppermost elongated opening of the light path 16 while the juxtaposed lens columns 28 of each group extend in a direction generally perpendicular to the lengthwise direction of the associated uppermost elongated opening of the light path 16.

On the lenticular lens plate 26, a Fresnel lens plate 30 having a plurality of groups of composite lens with a succession of concentric ring-shaped steps of different radius of curvatrues is laid with each of the groups of the composite lens portions opposed to the corresponding segments 20-1 to 20-7 or to the uppermost openings of the light paths 16 respectively.

An example of sizes of the respective components is as follows; These sizes can be also applied to the various embodiments hereinafter disclosed.

- size of a side of the light emitting diode: 0.3 through 0.5 mm
- height of the light reflecting block: 3.5 through 5 mm
- thickness of each of the lenticular plate 26 and Fresnel lens plate 30: 0.7 through 1.2 mm respectively
- radius of curvature of semicircular column of the lenticular lens plate 26: 0.25 through 0.8 mm
- pitch between the adjacent two columns of the lenticular lens plate 26: 0.25 through 0.6 mm
- radius of curvature of ring shaped steps of the Fresnel lens plate 30: 4.5 through 7 mm
- pitch between the adjacent ring-shaped step of the Fresnel lens plate 30: 0.2 through 0.4 mm A cover plate 32 are laid on the Fresnel lens plate 30 at both end portions of the composite lens part to conceal the peripheral portion of segments 20-1 through 20-7 where illuminated image of the segment tends to become dim.

The cover plate 32 may be omitted in case where both ends of the segment are clearly displayed.

It is noted that each of the ridgelines 40 and 41 of the Fresnel lens 30 and lens columns 28 of the lenticular lens 26 are directed in a direction perpendicular to the lengthwise direction of the uppermost opening of the light path 16.

When the light emitting diode 24 is illuminated, the lights emitted therefrom are reflected by the wall of the light path 16, the rays of light are directed to upward direction and in turn the rays of the light are passed through the lenticular lens plate 26. Thus, a number of the images of the light spot are made up at the respective focuses of each of the semi circular lens columns. Thus, the lenticular lens plate 26 acts to transmit the ray of the direct light emitted from the light emitting diode 24 to the Fresnel lens plate 30 in such a manner that as if there were a number of light spots at the focuses of the respective lens columns of the lenticular lens plate 26 and also acts to transmit the rays of the light reflected from the walls of the light path 16 to the Fresnel lens plate 30 as a beam of light connecting the light spots. Major parts of the light passed through the lenticular lense plate 26 are deemed to be emerged from the focuses of the Fresnel lense 30 whereby the rays of the light passed through the Fresnel lens plate 30 are broadly emerged so that the segment 20 is brightly and entirely illuminated without adjusting the focus of the Fresnel lens relative to the light emitting diode 24.

In the embodiment described above, although the lens parts of either of the lenticular lens plate 26 and the Fresnel lens plate 30 are formed on the upper surface thereof, the lens parts may be formed on the lower surface of the respective plates. Furthermore, both of the lenticular lens and the Fresnel lens can be formed on both opposed surface of a single transparent plate.

A translucent plate can be used as a lens plate. The lens plate may be colored.

Figure 6:
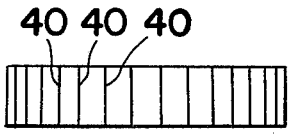
Figure 7:
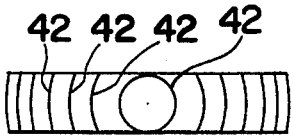
Figure 6:
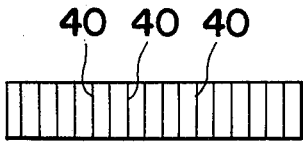
Figure 7:
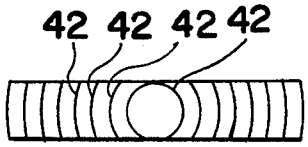

Furthermore, the lenticular lens plate 26 and the Fresnel lens plate 30 having the ridgelines formed with linear lines 40 as shown in FIGS. 6 (*a*) and (*b*) or concentric circular or semi circular lines 42 as shown in FIGS. 7 (*a*) and (*b*) may be used. Also, the lens plate with different shape of the ridgelines may be combined.

Figure 8:
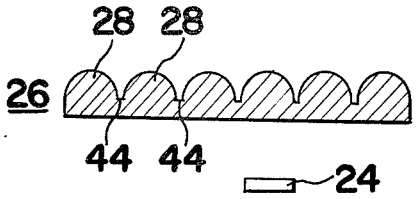
FIG. 8 is a front view showing a modified lenticular lens employed in the present invention.

FIG. 8 shows another embodiment of the present invention wherein the lenticular lens 26 is composed of a transparent plate having one surface formed with a plurality of juxtaposed lens columns of substantially semicircular cross-section, said lens columns 28 being so arranged side-by-side with the bottom of each plane 44 having rough surface between every adjacent two of said columns.

Figure 12:
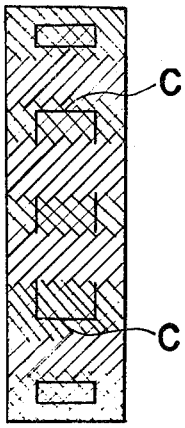
FIG. 12 is a plan view showing a features revealed in the display device in FIG. 3.

By the arrangement, light emitted from the light emitting diode 24 is dispersed by each of the bottom planes 44, thereby eliminating the images of contour lines C (as shown in FIG. 12) formed by the edge of the corresponding light emitting diode as revealed in the lenticular lens used in the embodiment shown in FIG. 5.

Furthermore, such lines corresponding to every contour lines formed in the dale between adjacent two lens columns as revealed in the lens plate shown in FIG. 5 are not displayed, so that uniformity of the brightness of the illuminated segment can be improved.

In this embodiment, the width of the narrow plane 44 is selected smaller than the diameter of the lens column 28. Desired result can be obtained when the ratio of the width of the narrow plane 44 and the diameter of the lens column 28 is within the range of 1:4 to 1:10. Furthermore, when the size of the light emitting diode 24 is small, it is preferred to change the ratio of the width of the narrow plane 44 and diameter of the lens column in such a manner that the ratio of the width of the narrow plane 44 and the diameter of the lens column 28 is smaller in correspondence with the distance between a corresponding point of the lens and the light emitting diode 24 so that the entire segment can be uniformly illuminated.

Figure 9:
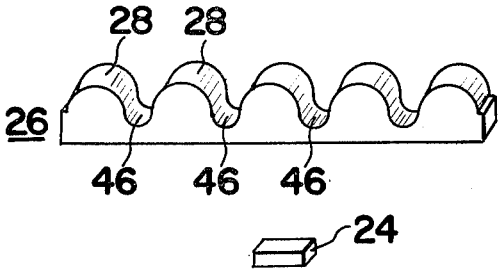
FIG. 9 is a front view showing other modified lenticular lens employed in the present invention.

FIG. 9 shows a further embodiment of the present invention wherein the lenticular lens plate 26 is composed of a transparent plate having one surface formed with a plurality of juxtaposed lens columns 28 of substantially semicircular cross-section, said lens columns 28 being so arranged side-by-side with the bottom of each dale 46 between every adjacent two of said columns being so rounded as to render the lenticular lens, when viewed in a direction parallel to the lens columns 28, to have a cross-sectional shape similar to the shape of a sinusoidal wave.

By this arrangement, respective images of the light spots formed on the segment 20 by the rays of the light passed through every lens columns 28 are continued by the rays of the light dispersed by the dale portion 46, thereby rendering the entire surface of one segment 20 to be illuminated with uniform brightness.

It is appreciated that the modified lenticular lens plate as shown in FIG. 9 is more effective to prevent the display of the contour lines of the respective lens columns on the segment than lenticular lens plate shown in FIG. 8.

FIG. 13 shows the relationships between lens column 28 and the dale 46 acting as a concave lens by classifying them in accordance with the radius of carvature and the width of respective lenses 28 and 46.

By using FIG. 13, various characteristics can be found as described bellow.

In the right half part of FIG. 13, as specified 'modified lenticular lens', the lenticular lens made under such relationship as shown in the left row is operable to effect as a convex lens and one shown in the right row is operable to effect as a concave lens. Furthermore, the one shown in upper part in the column shows strong function of a lens. Accordingly, it can be found that the lenticular lens classified by the right row ($l_{31}$, $l_{32}$, $l_{33}$ and $l_{34}$) in FIG. 13 is suitable for use in a lighting lamp and the lenticular lens classified by the intermediate row ($l_{21}$, $l_{22}$, $l_{23}$ and $l_{24}$) and preferably by the left row ($l_{11}$, $l_{12}$, $l_{13}$ and $l_{14}$) is suitable for use in a display device. For the emergency lamp, the lenticular lens classified by the left row is suitable. For display device used in a car or the like, which is usually viewed at a distance, the lenticular lens classified by the uppermost line ($l_{11}$, $l_{21}$) or the second line ($l_{12}$, $l_{22}$) is suitable because such lamp requires strong concentrated light. In case where a display is viewed at close distance relative to the lens, for example such a display device as used in an automatic vending machine, a lens classified by the lower two lines ($l_{13}$, $l_{14}$, $l_{23}$, $l_{24}$) is suitable. For commercial use, the lenticular lens classified by the intermediate lines ($l_{12}$, $l_{22}$, $l_{13}$ and $l_{23}$) is readily used. Particularly the lens classified by the leftmost row ($l_{12}$ and $l_{13}$) is most preferable.

Figure 10:
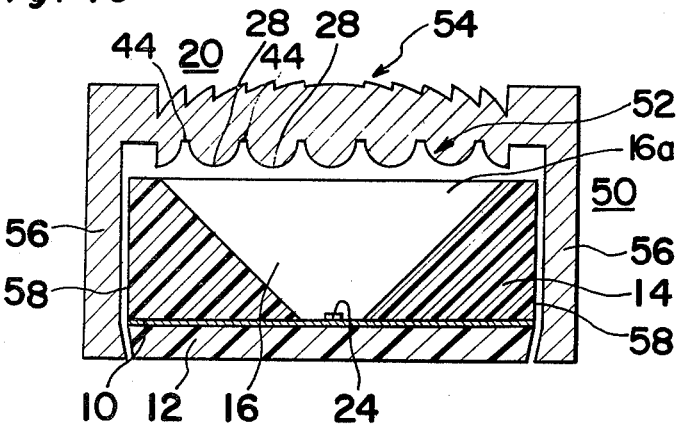
FIG. 10 is a cross sectional view of an embodiment of a display device of the present invention in which the modified lenticular lens shown in FIG. 8 is employed.

FIG. 10 shows an embodiment of a display device according to the present invention in which such modified lenticular lens as shown in FIG. 8 is used in association with a Fresnel lens.

As shown in FIG. 10, a composite lens plate 50 made of a transparent plate having a modified lenticular lens part 52 formed on the lower face of lens plate 50 in a similar manner as shown in FIG. 8 and a Fresnel lens part 54 formed on the upper face thereof is mounted on the light reflecting block 14 so as to cover the upper face thereof. The composite lens plate 50 is fixed to the light reflecting block 14 by engaging both side walls 56 to the side faces 58 of the light reflecting block 14.

The modified lenticular lens part 52 is composed of a plurality of juxtaposed lens columns 28 and narrow bottom planes 44 formed between adjacent two lens columns 28 and is opposed to the upper opening 16*a*, or the segment 20 in such a manner that the longitudinal axes of every lens columns 28 are directed in a direction perpendicular to the lengthwise direction of the corresponding segment 20.

In the display device as described above, when the light emitting diode 24 is emitted, the rays of the light emitted therefrom is passed through the light path 16 and the composite lens plate 50, thereby illuminating the segment 20 for displaying one of the alpha numeric characters in association with other segments (not shown) illuminated by corresponding light emitting diode.

The rays of the light passed through the lenticular lens part 52 are formed into a strip of light in the similar manner as described above, and in turn, being directed to the upward direction, thereby rendering the segment 20 to illuminate uniformly.

It is an advantage of the display device according to the present invention that the segment can be illuminated uniformly without adjusting the focus of the Fresnel lens 54 relative to the light emitting diode by combining the lenticular lens and the Fresnel lens, since many real images and virtual images of the light emitted from the light emitting diode 24 are formed by the lenticular lens part 52 and these images can act as light sources located on respective focuses of the Fresnel lens part 52.

Furthermore, the light reflected by the walls of the light path 16 are effectively transmitted to the segment 20 so that the light emitted from the light emitting diode 24 can be used to illuminate the segment with high efficiency.

Figure 11:
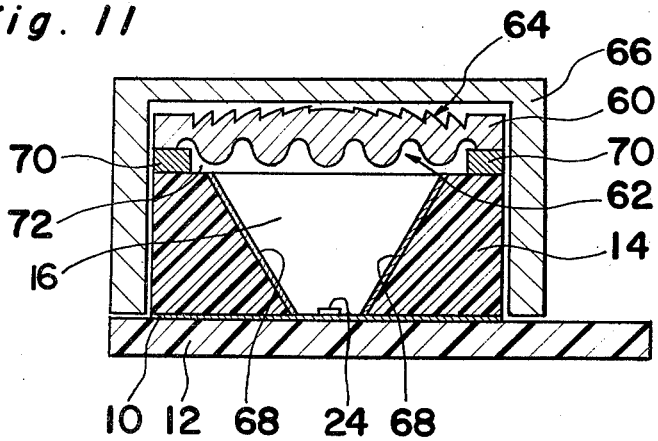
FIG. 11 is a cross sectional view showing an embodiment of the present invention in which a modified lenticular lens shown in FIG. 9 is employed.

FIG. 11 shows an embodiment of the display device of the present invention wherein the lenticular lens shown in FIG. 9 is employed in association with the Fresnel lens. As shown in FIG. 11, the composite lens plate 60 having a modified lenticular lens part 62 formed in the manner similar to the lens shown in FIG. 9 on its lower surface and a Fresnel lens part 64 formed on its upper surface is laid on the light reflecting block 14. The composite lens plate 60 and the light reflecting block 14 are covered with suitable cover plate 66 made of transparent material.

In order to increase the efficiency of the reflection of light, the walls of the light reflecting path 16 are coated with light reflecting surfaces 68.

In the embodiment shown in FIG. 11, the lenticular lens part 62 and the Fresnel lens part 64 may be formed on two separated transparent plates, and the configuration and size of the lens can be changed in accordance with the use of the display device.

In case where a plurality of the display segments are covered by a single lens plate having a plurality of composite lens parts, each of which is formed in correspondence with the respective segments, when one of the segments is illuminated by the corresponding light emitting diode, other segment situated adjacent to said one segment may idly displayed, although it is vague, by the light coming from the one segment. In order to prevent such idle display of the segment, mask members 70 having an opening 72 may be located between the lens plate 60 and the light reflecting block 14 so as to shield the light coming from the adjacent segment. Preferably, the width of the opening 72 of the mask member 70 is narrower than the size of the uppermost opening 16*a* in a direction of the ridgeline of the lens column 28 of the lenticular lens part 62.

Figure 14:
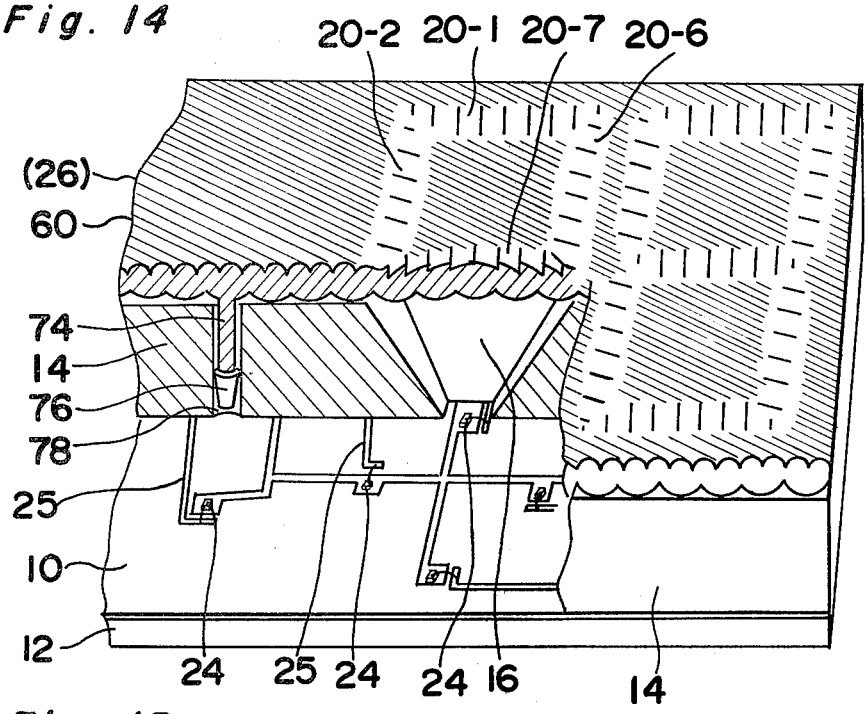
FIG. 14 is a perspective view showing an example of a way of fixing a lens plate on a light reflecting block.

FIG. 14 shows a way of fixing the composite lens plate 26 or 60 wherein the coloured lens plate 60 is provided with at least one leg 74 extending downwardly from the bottom of the lens plate 60, having tapered portion 76 and the leg 74 is adapted to be inserted in the hole 78 defined in the light reflecting block 14 in a downward direction. As shown in FIG. 14, the outermost edge of the tapered portion 76 is engaged with the inside wall of the hole 78 so that the coloured lens plate 60 is fixed on the light reflecting block 14. The number of the legs and the holes can be determined as desired.

Figure 15:
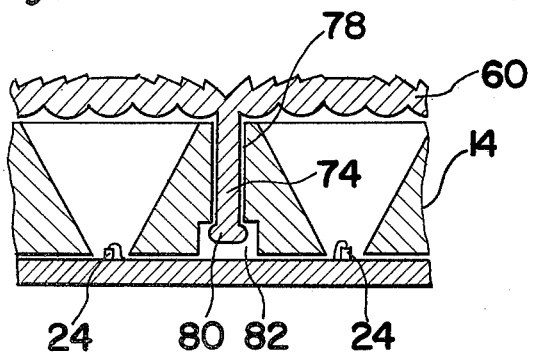
FIG. 15 is a cross sectional view showing another example of a way of fixing a lens plate on a light reflecting block.

In the embodiment shown in FIG. 15, the leg 74 is provided with an enlarged end portion 80 which extends into a recess 82 defined in the bottom portion of the light reflecting block 14 and enlarged end portion 80 is engaged with the top face of the recess 82.

Figure 16:
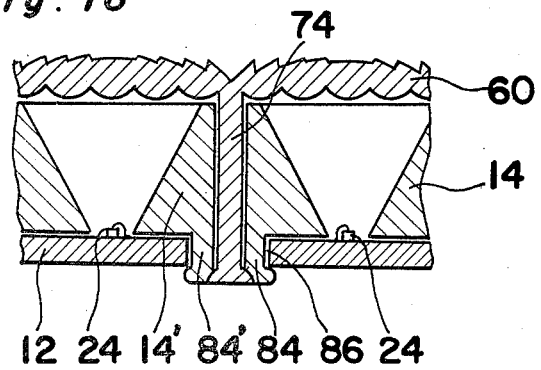
FIG. 16 is a cross sectional view showing a further example of a way of fixing a lens plate on a substrate.

In the embodiment shown in FIG. 16, the leg 74 are adapted to extend paralelly and/or coaxially with respective projections 84 and 84' extending from the bottom of the light reflecting blocks 14 and 14' and the leg 74 is inserted in the hole 86 defined in the substrate 12 together with the projections 84 and 84' so that the coloured lens plate 60 and the light reflecting block 14 are simultaneously fixed to the substrate 12.

Figure 17:
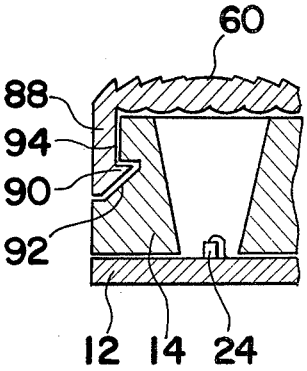
FIG. 17 is a cross sectional view showing a still further example of a way of fixing a lens plate on a light reflecting block.

In the embodiment shown in FIG. 17, the lens plate 60 has a plurality of legs 88 (only one of them is shown in the drawing) extending downwardly, the leg 88 is terminated with engaging projection 90 which is engaged within a corresponding recess 92 defined in the intermediate portion of the side face of the light reflecting block 14. The leg 88 is adapted to be fitted within a slot 94 defined on the side portion of the light reflecting block 14. By the arrangement, the projection 90 is engaged with the recess 92 fitting the leg 88 with the slot 94, whereby the coloured lens plate 60 is fixed to the light reflecting block 14.

When a plastic resin plate is molded simultaneously with one or more projections protruded from the plate, it is well known that one or more recesses so called shrinkage marks tend to be formed at the respective portions corresponding to the projections on the surface of the plate.

Such plate having shrinkage marks is not suitable for use as a cover plate of a display device.

However, according to the lens plate 60 having legs 74 as shown in FIGS. 14 to 16, such shrinkage marks are effectively eliminated partly because the legs 74 is formed in the plate having composite lens parts formed on the surface of the plate partly because the lens plate is made of a coloured transparent or translucent plate.

Thus, according to the embodiment shown in FIGS. 14 to 17, there can be provided a display device not only being capable of illuminating with uniform and intensive brightness but also having a good appearence without undesired defects present on the outer surface thereof.

Following table shows the relationships between the brightness of the illuminated segment and the current of the light emitting diode obtained by a display device of the present invention and a conventional display device.

The display devices adopted in this example are used under such conditions.

(a) The light emitting diode is made of GaP illuminating in green, the brightness of which is lower than the light emitting diode of other type.

(b) In the conventional display device, the segment of the light reflecting block is covered with a light diffusion sheet.

(c) In the display device of the present invention, the segment of the light reflecting block is covered with a composite lens plate coloured in green.

| current of the light emitting diode (mA) | brightness of the segment | |
|---|---|---|
| | present invention (μcd) | conventional device (μcd) |
| 5 | 480 | 270 |
| 10 | 1,220 | 660 |
| 15 | 2,040 | 1,120 |
| 20 | 2,880 | 1,580 |

As understood from the above table, the brightness of the display device of the present invention is nearly twice that of the conventional one relative to the same current of the light emitting diode, whereby clear and light display can be obtained.

The invention being thus described, it will be obvious that the same may be varied in many ways. Such variations are not to be regarded as a departure from the spirit and scope of the invention, and all such modifications are intended to be included within the scope of the following claims.

For example, the lens plate used in the various embodiments described above may be translucent and/or coloured transparent or translucent plate, and the lenticular lens plate can be formed or laid on the Fresnel lens plate.

Furthermore, the respective segments defined by the top openings of the light paths may be arranged so as to constitute a desired mosaic pattern, such as one of the alphabets, Chinese or Japanese characters.

What is claimed is:

1. A display device which comprises at least one light emitting diode supported on supporting means, means for supporting electric power to the light emitting diode, light reflecting block means supported on the supporting means and having at least one light path defined by wall members surrounding the light emitting diode for reflecting the light emitted therefrom, said light path being provided with an elongated opening for forming a display segment opposed to the light emitting diode, first composite lens means having a plurality of juxtaposed lens columns, positioned above the light reflecting block means to cover the elongated opening, and second composite lens means having a Fresnel lens portion positioned relative to the first composite lens means, whereby the light emitted from the electrically activated light emitting diode is passed through the light path, the first composite lens means and the second composite lens means.

2. A display device according to claim 1, wherein the direction on the ridge lines of the lens columns of the first composite lens means is aligned with the direction of the ridge lines of the Fresnel lens of the second composite lens means.

3. A display device according to claim 1, wherein either of the ridge lines of the lens columns of the first composite lens means and the ridge lines of the Fresnel lens of the second composite lens means is directed in a direction perpendicular to the lengthwise direction of the corresponding display segment.

4. A display device according to claims 3, wherein the second composite lens means is formed on the first composite lens means.

5. A display device according to any one of the claims 3 or 4, wherein the first composite lens means is a lenticular lens plate.

6. A display device any one of the claims 3 or 4, wherein a plurality of light paths are formed in the light reflecting block means in such a manner that respective openings of the light paths are arranged to constitute a shape showing a predetermined mosaic pattern.

7. A display device according to any one of the claims 3 or 4, wherein a plurality of light paths are formed in the light reflecting block means in such a manner that respective openings of the light paths are arranged to constitute a shape showing a character of a FIG. 8.

8. A display device according to any one of the claims 3 or 4, wherein at least one light emitting diode is situated on a print circuit board.

9. A display device according to any one of the claims 3 or 4, wherein the first composite lens means and the second composite lens means are formed on both sides of a single transparent or translucent plate.

10. A display device according to claim 9, wherein the second composite lens means is formed on the upper side of the transparent or translucent plate.

11. A display device according to any one of the claims 3 or 4, wherein the peripheral portion of each of the segments is masked by a mask plate laid on the second composite lens means.

12. A display device according to any one of the claims 3 or 4, wherein said light emitting diode is made of GaP diode.

13. A display device according to any one of the claims 3 or 4, wherein the length of pitch between adjacent two lens columns of the first composite lens means is substantially equal to the length of one side of the lighting area of the light emitting diode.

14. A display device which comprises at least one light emitting diode supported on supporting means, means for supplying electric power to the light emitting diode, light reflecting block means supported on the supporting means and having at least one light path defined by wall members surrounding the light emitting diode for reflecting the light emitted therefrom, said light path being provided with an elongated opening for forming a display segment opposed to the light emitting diode, and composite lens means positioned on the light reflecting block means to cover the opening of the light path, said composite lens means having a plurality of juxtaposed lens columns substantially semicircular in cross section, said lens columns being so arranged side-by-side with the bottom of each valley between adjacent columns being rounded as to form a concave lens, whereby the light emitted from the electrically activated light emitting diode is passed through the light path and the composite lens means.

15. A display device according to claim 14, further including a second composite lens means having at least one Fresnel lens portion positioned on the composite lens means.

* * * * *